US010336415B2

(12) United States Patent
Kellogg et al.

(10) Patent No.: US 10,336,415 B2
(45) Date of Patent: Jul. 2, 2019

(54) WATERCRAFT LIFT SYSTEM AND METHOD

(71) Applicant: Autolift, LLC, Walker, MN (US)

(72) Inventors: David Alan Kellogg, Walker, MN (US); Ryan Dietrich Bruns, Walker, MN (US)

(73) Assignee: Autolift, LLC, Walker, MN (US)

( * ) Notice: Subject to any disclaimer, the term of this patent is extended or adjusted under 35 U.S.C. 154(b) by 0 days.

(21) Appl. No.: 15/665,473

(22) Filed: Aug. 1, 2017

(65) Prior Publication Data

US 2018/0037306 A1 Feb. 8, 2018

Related U.S. Application Data

(60) Provisional application No. 62/514,217, filed on Jun. 2, 2017, provisional application No. 62/369,806, filed on Aug. 2, 2016.

(51) Int. Cl.

| | |
|---|---|
| ***B63C 3/06*** | (2006.01) |
| ***B63B 27/14*** | (2006.01) |
| ***B63B 27/16*** | (2006.01) |
| ***B63C 3/12*** | (2006.01) |
| *B63B 27/36* | (2006.01) |

(52) U.S. Cl.

CPC ..... *B63C 3/06* (2013.01); *B63B 27/143* (2013.01); *B63B 27/16* (2013.01); *B63C 3/12* (2013.01); *B63B 27/36* (2013.01)

(58) Field of Classification Search

CPC ..... B63C 3/06; B62B 27/143; B63B 27/16; B63B 27/36

See application file for complete search history.

(56) References Cited

U.S. PATENT DOCUMENTS

| | | | | |
|---|---|---|---|---|
| 4,103,925 A | | 8/1978 | Palamara | |
| 5,184,914 A | | 2/1993 | Basta | |
| 5,772,360 A | * | 6/1998 | Wood, II | B63C 3/06 114/48 |

(Continued)

FOREIGN PATENT DOCUMENTS

| | | |
|---|---|---|
| CA | 2787879 C | 1/2017 |

*Primary Examiner* — Benjamin F Fiorello

(74) *Attorney, Agent, or Firm* — Gregory W. Smock

(57) ABSTRACT

A watercraft lift system including one or more laterally-adjustable components and a related method are disclosed. The watercraft lift system can include a cradle assembly and optionally at least one side guide, which can be connected to the cradle assembly. The cradle assembly can include substantially parallel first and second cradle rails. One or both of the first cradle rail and the at least one side guide can be movable in a lateral direction between a wider watercraft-receiving position and a narrower watercraft-received position. In an example, lateral movement of the first cradle rail and/or the at least one side guide from the watercraft-receiving position to the watercraft-received position occurs automatically upon entry of a watercraft into the confines of the watercraft lift system. The watercraft lift system can further comprise an actuator to cause lateral movement of the first cradle rail and/or the at least one side guide. In an example, the actuator can be operably connected to the first cradle rail and/or the at least one side guide via one or more cables or extension plate members.

22 Claims, 9 Drawing Sheets

(56) References Cited

U.S. PATENT DOCUMENTS 5,890,835 A 4/1999 Basta et al.
5,908,264 A 6/1999 Hey
5,911,189 A 6/1999 Ryan
6,007,288 A * 12/1999 Maffett ..... B63C 15/00 414/254
6,032,601 A * 3/2000 Gates ..... B63C 1/02 114/45
6,405,670 B1 6/2002 Desantis
6,550,584 B1 * 4/2003 Granata ..... B66F 7/04 187/213
6,554,533 B2 * 4/2003 Godbersen ..... B63C 3/06 114/44
6,575,110 B1 6/2003 Nelson
6,830,002 B1 12/2004 Walker
6,830,410 B2 12/2004 Davidson et al.
6,904,857 B1 6/2005 Holden
7,090,431 B2 8/2006 Cosgrove et al.
7,112,007 B2 * 9/2006 Maffett ..... B63C 15/00 405/3
7,383,781 B1 6/2008 Griffin
7,534,069 B1 5/2009 Stanley
8,979,426 B2 3/2015 Doig
9,114,856 B2 8/2015 Hannan et al.
9,284,026 B2 3/2016 Harrell
2004/0020417 A1 2/2004 Krentz
2006/0177271 A1 * 8/2006 Maffett ..... B63C 15/00 405/1
2008/0306642 A1 12/2008 Figura et al.
2009/0185861 A1 * 7/2009 Stanley ..... B63C 3/06 405/3
2009/0235857 A1 9/2009 Hodapp
2010/0209191 A1 8/2010 Griffin et al.
2012/0263534 A1 * 10/2012 Heller ..... G05B 19/106 405/3
2017/0043849 A1 2/2017 Brown

* cited by examiner

WATERCRAFT LIFT SYSTEM AND METHOD

CLAIM OF PRIORITY

This non-provisional patent document claims the benefit of priority under 35 U.S.C. § 119(e) to U.S. Provisional Patent Application Ser. No. 62/369,806, entitled "BOAT LIFT SYSTEM" and filed on Aug. 2, 2016, and to U.S. Provisional Patent Application Ser. No. 62/514,217, entitled "BOAT LIFT SYSTEM" and filed on Jun. 2, 2017, each of which is herein incorporated by reference in its entirety.

TECHNICAL FIELD

This patent document relates to lift systems and methods. More particularly, but not by way of limitation, the patent document relates to watercraft lift systems and methods.

BACKGROUND

Recreational boating is a large industry in this country and elsewhere. Many people own a boat, pontoon, jet ski or other watercraft (collectively "watercraft"), which can be used for fishing, sightseeing, water skiing, and other recreational pursuits. Some watercraft are docked permanently in a marina. Other watercraft are placed in the water only when used. In these instances, the watercraft may be launched at a shore ramp from a trailer or other transport device when it is desired to use the watercraft, and the watercraft is replaced on the trailer after completing use.

Some watercraft owners live directly on navigable water (e.g., a lake, river or ocean). Ordinarily, watercraft owners who live on navigable water will have a dock, to which they can moor their watercraft while getting in and out of it before and after use. However, leaving the watercraft in water for extended periods of time can cause problems of various kinds. First, marine organisms, vegetation, and the like may grow on and damage the bottom or hull of the watercraft. Second, if the watercraft is near a waterway where other watercraft pass, these watercrafts may create wakes that can urge the moored watercraft into the dock, damaging the dock and/or the watercraft. Therefore, many people who have a dock on navigable water will use a watercraft lift system (also commonly referred to as a boat lift) to protect their watercraft from wave and wake action, as well as from marine organisms. The lift system can be used for lowering the watercraft into the water for use and hoisting the watercraft out of the water after use.

OVERVIEW

The present inventors recognize that piloting a watercraft into the confines of a conventional lift system, which includes a fixed entrance width slightly larger than the width of the watercraft, can present several challenges. First, certain adverse conditions such as wind and rough water can undesirably force the watercraft laterally prior to entering the lift system. Second, steering the watercraft can be difficult because direction of travel of the front of the watercraft is accomplished indirectly by changing the relative orientation of the back of the watercraft. By contrast, changing the direction of travel of the front of a wheeled vehicle is directly accomplished via the front wheels, and is thus easier to control. Third, it can be difficult to make abrupt changes in the direction of travel of a watercraft at the low speeds that are typical when entering a lift system. Operator inexperience can make the piloting process even more difficult. Put simply, piloting a watercraft into the confines of a conventional lift system is difficult, and if the watercraft contacts the lift structure during the mooring process, the damage potential to the watercraft and lift can be significant.

The present inventors further recognize that centering a watercraft on cradle rails of a lift system before the watercraft is hoisted from the water can also present challenges. Rough water and strong winds can slow the centering process. Time and fuel can be wasted in repeated attempts to correctly position the watercraft. If weather conditions are severe, property loss can result from repeated delays in hoisting the watercraft.

A need exists for a watercraft lift system and related method that simplifies the mooring process by providing a wider watercraft-receiving entrance and an automated mechanism to center a received watercraft on the lift's cradle rails for hoisting the watercraft from the water. The present watercraft lift system can comprise a cradle assembly and optionally at least one side guide, which can be connected to the cradle assembly. The cradle assembly can include substantially parallel first and second cradle rails. One or both of the first cradle rail and the at least one side guide can be movable in a lateral direction between a wider watercraft-receiving position and a narrower watercraft-received position. In an example, lateral movement of the first cradle rail and/or the at least one side guide from the watercraft-receiving position to the watercraft-received position occurs automatically upon entry of a watercraft into the confines of the watercraft lift system. The watercraft lift system can further comprise an actuator to cause lateral movement of the first cradle rail and/or the at least one side guide. In an example, the actuator can be operably connected to the first cradle rail and/or the at least one side guide via one or more cables or extension plate members.

A method of piloting a watercraft into a watercraft lift system comprises lowering a cradle assembly, including first and second cradle rails and optionally supporting first and second side guides, into water; ensuring the first cradle rail and/or first side guide is in a watercraft-receiving position and if it's not, laterally moving the first cradle rail and/or first side guide until such positioning is achieved; piloting the watercraft into confines of the watercraft lift system; laterally moving the first cradle rail and/or first side guide toward a side of the watercraft to a watercraft-received position; and lifting the watercraft vertically out of the water. In an example, the first cradle rail and/or first side guide are laterally moved toward the side of the watercraft while the watercraft is lifted vertically out of the water. In an example, a distance between the watercraft-receiving position and the watercraft-received position of the first cradle rail and/or first side guide is at least about 20 inches or at least about 36 inches.

These and other examples and features of the present watercraft lift system and method will be set forth, at least in part, in the following Detailed Description. This Overview is intended to provide non-limiting examples of the present subject matter—it is not intended to provide an exclusive or exhaustive explanation. The Detailed Description below is included to provide further information about the present watercraft lift system and method.

BRIEF DESCRIPTION OF THE DRAWINGS

In the drawings, like numerals can be used to describe similar features and components throughout the several views. The drawings illustrate generally, by way of example, but not by way of limitation, various system and method embodiments discussed in this patent document.

The drawings are not necessarily to scale. Certain features and components may be shown exaggerated in scale or in schematic form, and some details may not be shown in the interest of clarity and conciseness.

DETAILED DESCRIPTION

The present watercraft lift system and method simplify a watercraft mooring process by providing a wider watercraft-receiving entrance than conventional lift systems, to allow for easier piloting of a watercraft into the lift's confines, and subsequent automated centering of the received watercraft onto the lift's cradle rails. Once a watercraft is piloted within the lift's confines, at least one laterally-adjustable cradle rail and/or side guide can move toward a side of the watercraft aligning the watercraft onto cradle rails prior to hoisting it above the water. The lateral adjustment concept of the present watercraft lift system can be incorporated into new lifts or retrofit into existing lifts, as one of ordinary skill in the art will appreciate. Problems of watercraft misalignment relative to a lift's entrance or cradle rails, which can be caused by heavy winds or waves or the difficulty of precisely steering watercraft, can be alleviated by the present subject matter.

Figure 1:
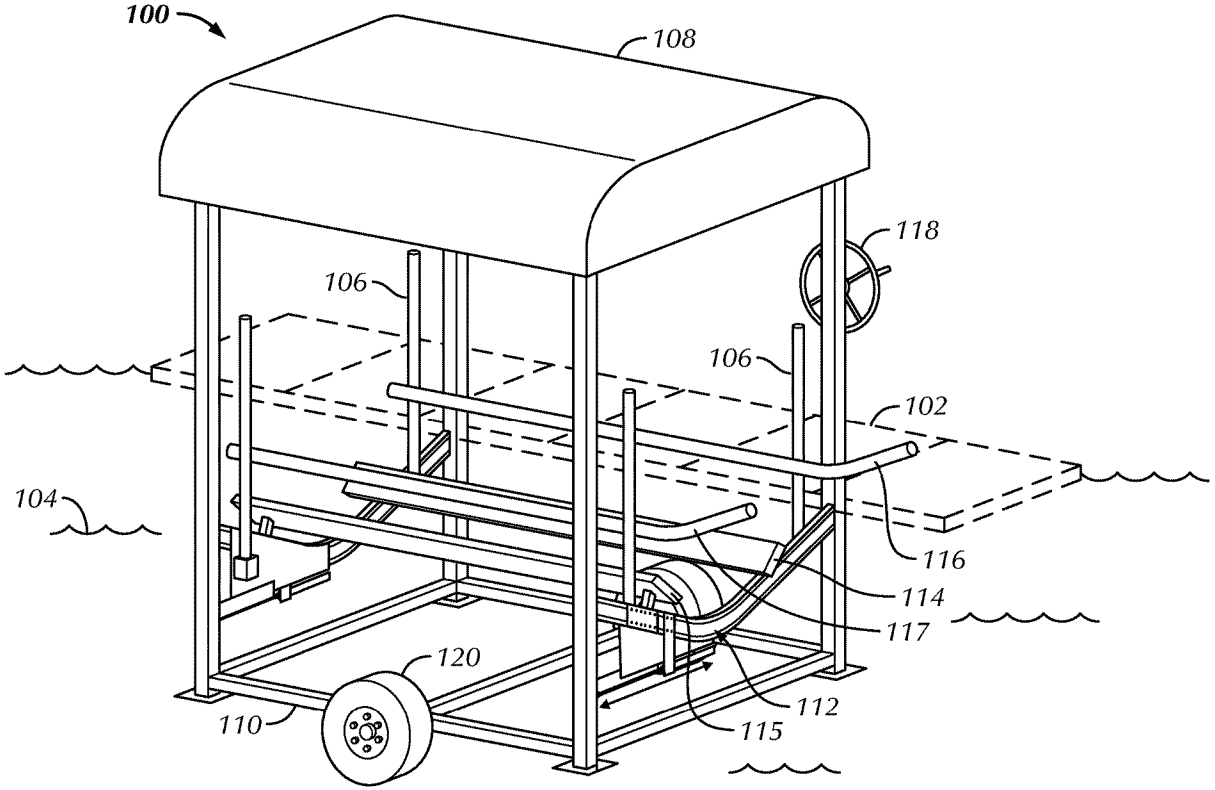
FIG. 1 illustrates a perspective view of a present watercraft lift system, as constructed in accordance with at least one embodiment, positioned adjacent to a dock.

FIG. 1 illustrates a perspective view of a present watercraft lift system 100 positioned adjacent to a dock 102. The lift system 100 can be used for lowering a watercraft into a body of water 104 and hoisting the watercraft out of the water. The lift system 100 can include four vertical pilings or posts 106 that optionally include base pads for resting on the water bottom. Secured to these piling or posts 106 can be a canopy 108 and a lower frame assembly 110. The lower frame assembly 110 can include a plurality of beams interconnecting the pilings or posts 106 at a location proximate the pads, yet high enough to avoid obstructions on the water bottom. Disposed above the lower frame assembly 110 can be a cradle assembly 112 including cradle rails 114, 115 on which a hull of the watercraft may rest. The cradle rails 114, 115 can optionally include a bunk assembly that conforms to the hull of the received watercraft. Side guides 116, 117, which are optionally padded, can be supported at their bases by the cradle assembly 112 or alternatively the frame assembly 110 and extend upward. At least one cradle rail 114, 115 and/or side guide 116, 117 can be laterally-adjustable within the confines defined by the pilings or posts 106.

The cradle assembly 112 can be attached by pulleys to at least one cable, which can be connected to a reel 118. The reel 118 can be powered either manually or by a drive system (e.g., a motor, a gear reducer and a drive unit) and acts like a winch to extend or retract the cable. As the cable extends, it lowers the cradle assembly 112 relative to the pilings or posts 106, and as the cable retracts, it raises the cradle assembly 112 relative to the pilings or posts 106. The cradle assembly 112 can be free to move as far down as the lower frame assembly 110 and as high as a predefined upper limit that is found to be stable for the lift system 100. Guides attached at corners of the cradle assembly 112 can engage the pilings or posts 106 to keep the cradle assembly in registered alignment and translate without binding.

To use the lift system 100, the cradle assembly 112 is lowered into the water 104 by unwinding the cable from the reel 118. The user then guides or pilots the watercraft into the lift's confines and at least one cradle rail 114, 115 and/or side guide 116, 117 converges toward a side of the watercraft aligning it onto the lift's cradle rails. Optionally, the cradle assembly 112 can be partly lifted out of the water 104 at the same time the at least one cradle rail 114, 115 and/or side guide 116, 117 laterally converges. The user can then activate the reel 118 to rewind the cable, thereby fully lifting the cradle assembly 112 and the watercraft now supported by the assembly out of the water 104. This accomplishes two desirable outcomes. First, the hull of the watercraft is no longer exposed to marine organisms in the water 104. Secondly, because the watercraft is no longer in water 104, wave or wake action will not affect (e.g., damage) the watercraft. It will be appreciated by those of ordinary skill in the art that other configurations of the lower frame assembly 110, cradle assembly 112, cradle rails 114, 115, side guides 116, 117, and/or reel 118 may be employed in accordance with other embodiments of the present lift system 100.

Watercraft lift systems can be quite large to accommodate watercraft of up to 6,000 pounds or more. Accordingly, components of the present lift system 100 can be made from metal, such as aluminum, and have weights on the order of hundreds of pounds, making it difficult to move the system. To provide moving assistance, one or more wheels 120 can be added to each side of the lift system 100.

Figure 2:
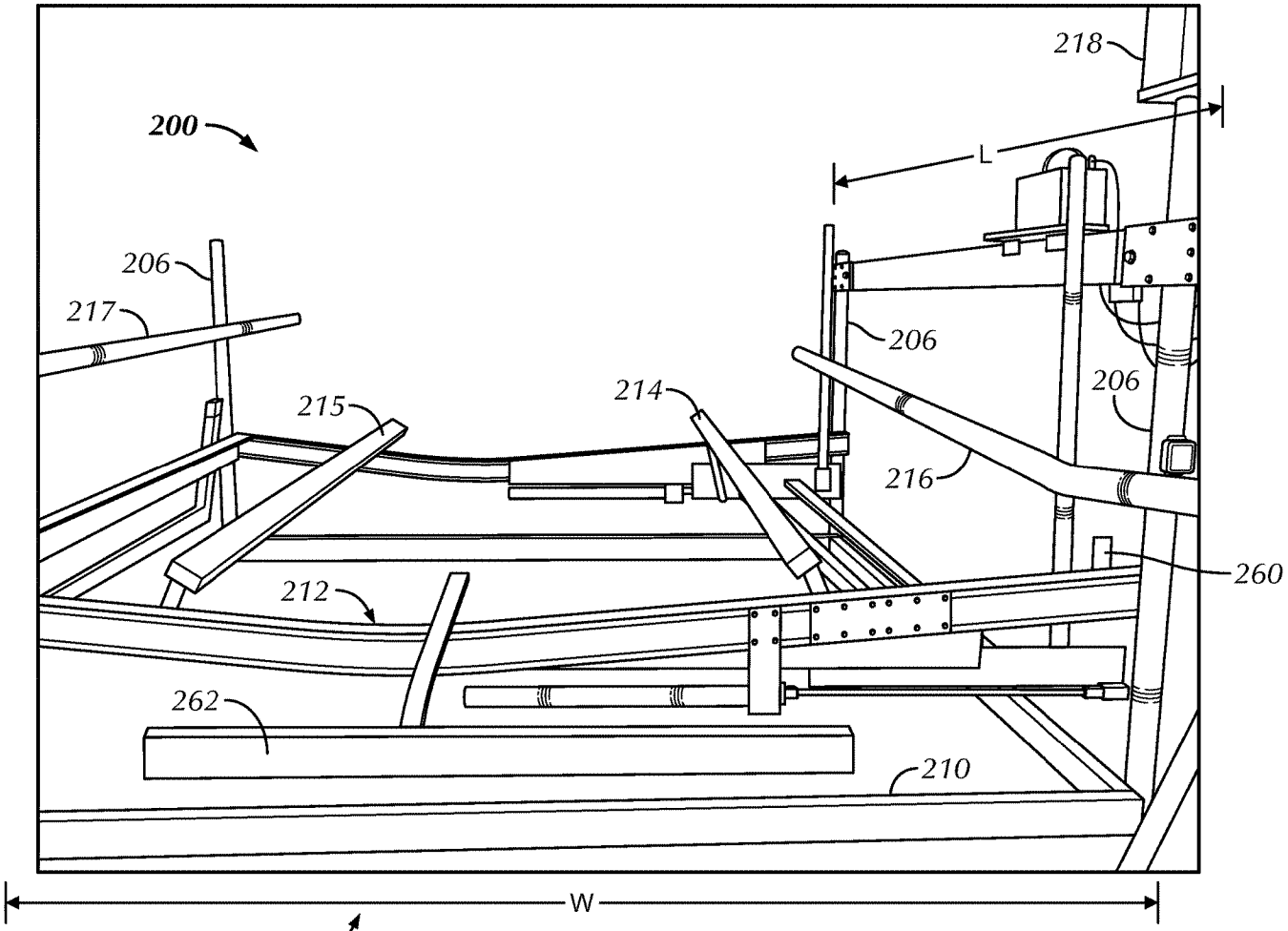
FIG. 2 illustrates a front view of a present watercraft lift system, as constructed in accordance with at least one embodiment, in a lowered, watercraft-receiving position.

FIG. 2 illustrates a front view of a present watercraft lift system 200 in a lowered, watercraft-receiving position. Confines of the lift system 200 can be defined by four corner pilings or posts 206 and a lower frame assembly 210 interconnecting the piling or posts 206 near their bases. The confines include a width W and a length L. In some examples, the width W of the lift system 200 can be at least about 20-36 inches wider than conventional lift systems—components of the lift system can be hinged or have a telescoping configuration to allow for easier transport to its destination. Disposed above the lower frame assembly 210 and within the lift's confines can be a cradle assembly 212. The cradle assembly 212 can include cradle rails 214, 215, on which the hull of a watercraft may rest, and optionally support vertically-extending side guides 216, 217.

Figure 4:
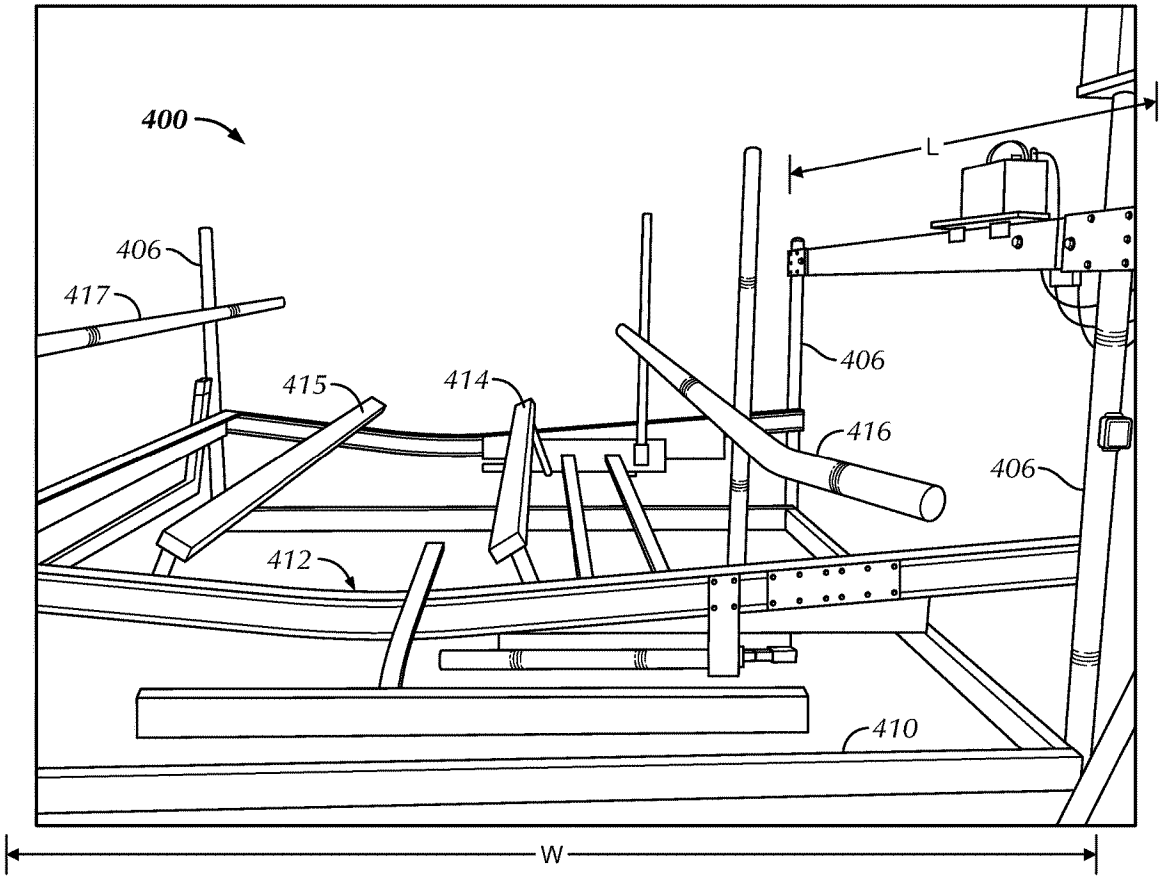
FIG. 4 illustrates a front view of a present watercraft lift system, as constructed in accordance with at least one embodiment, in a lowered, watercraft-received position.
Figure 5:
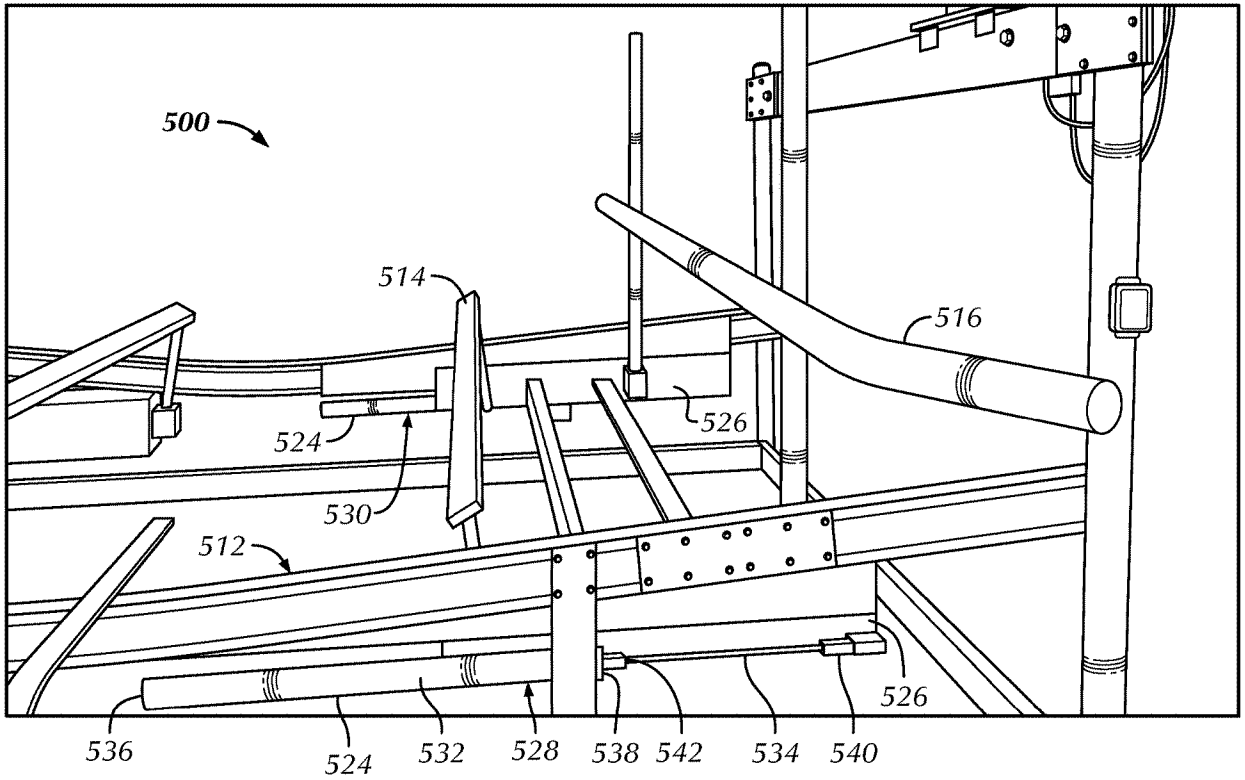
FIG. 5 illustrates a fragmented front view of a portion of the watercraft lift system shown in FIG. 4.

At least one cradle rail 214 and/or side guide 216 can laterally move between the watercraft-receiving position shown and a watercraft-received position (shown in FIGS. 4 and 5). In the watercraft-receiving position, the at least one side guide 216 can assume a position that is adjacent to the width W confines on one side of the lift system 200 and about 140 inches or more, for example, from the other side guide 217. The at least one cradle rail 214 can similarly assume a wider position that is about 36 inches or more, for example, from a center of a watercraft's hoisted position. The lateral expansion of the side guide 216 and/or cradle rail 214 allows the lift system 200 to provide a watercraft-receiving entrance 222 that is 20-36 inches, for example, wider than convention lift systems, thereby allowing for easier watercraft piloting into and out of the lift.

One or more of the cradle rails 214, 215 and/or side guides 216, 217 can be formed to further facilitate watercraft entry into the lift system 200 and reduce or avoid damage to the watercraft or the lift. For example, a front or leading portion of each side guide 216, 217 or cradle rail 214, 215 can be formed to angle outward, creating a funnel shape into which the front of the watercraft can be directed. This funnel shape can accommodate misalignment of the watercraft as it is piloted into the lift system 200, acting to guide the front-end of the watercraft into acceptable alignment as it enters the lift. The rails 214, 215 and guides 216, 217 can be made of wood, plastic, composites or similar materials that absorb energy, without incurring significant damage, and reduce friction to allow sliding contact as the watercraft is directed into the lift system 200. Further, the rails 214, 215 and/or guides 216, 217 can have a scratch-inhibiting surface by surrounding them with a carpet or padded casing, for example.

Figure 3:
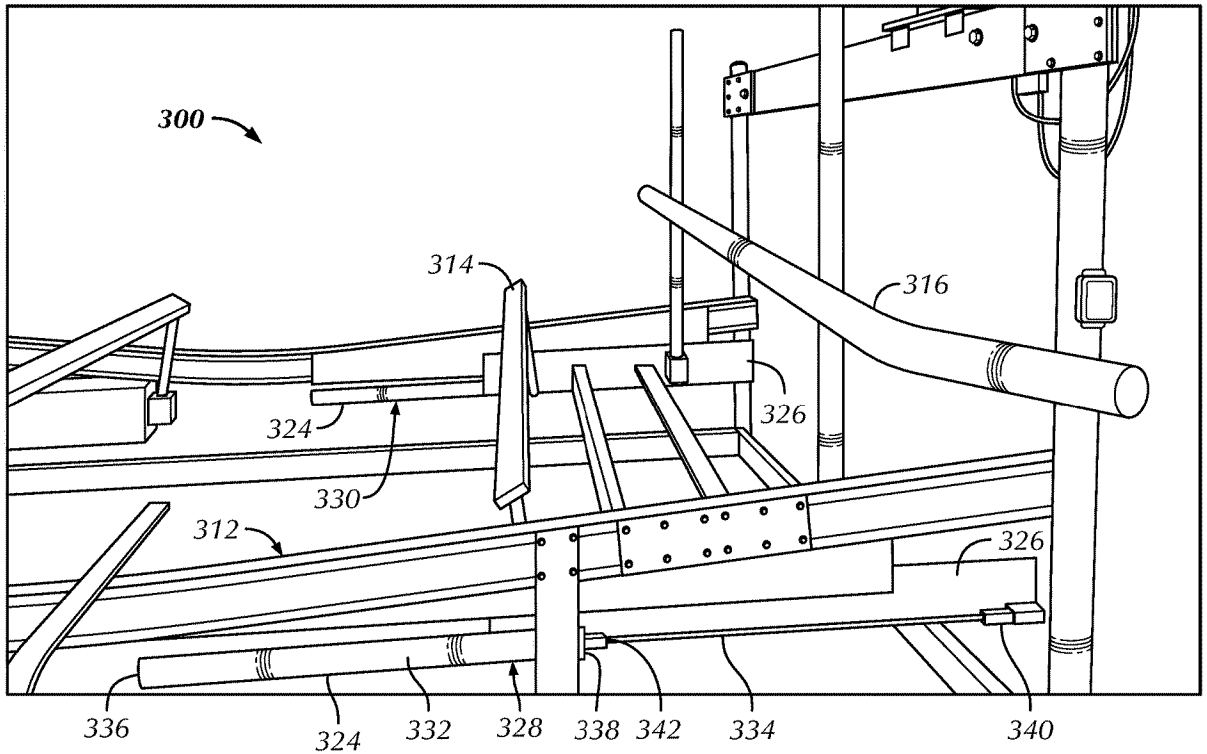
FIG. 3 illustrates a fragmented front view of a portion of the watercraft lift system shown in FIG. 2.

FIG. 3 illustrates a fragmented front view of one side of the watercraft lift system shown in FIG. 2. One of ordinary skill in the art will appreciate that similar or duplicate features shown and described in this drawing can be incorporated on the other side of the lift system such that both cradle rails 314, 315 and/or both side guides 316, 317 can move between watercraft-receiving and watercraft-received positions.

As shown in FIG. 3, a cradle assembly 312 can include one or more actuators 324 connected to one or more extension plate members 326 to move a cradle rail 314 and a side guide 316 between the watercraft-receiving position shown and a watercraft-received position (shown in FIGS. 4 and 5). In this example, the cradle assembly 312 includes a first actuator and extension plate member combination 328 at the front of the lift system 300 and a second actuator and extension plate member combination 330 at the back of the lift system 300. Front and back end portions of the side guide 316 and the cradle rail 314 can be connected to the extension plate members 326 so that movement of the plate members by the actuators 324 causes corresponding movement of the cradle rail and the side guide. It will be appreciated by those of ordinary skill in the art that other configurations for laterally moving the cradle rail 314 and the side guide 316, such as configurations including sliding, telescoping or rolling members, may be employed in accordance with other embodiments of the present lift system 300. In an example, one or more actuators are operably connected to the cradle rail and/or the side guide via a cable or other elongate member. An actuator can cause movement of the cable, which in turn can cause movement of the cradle rail and/or the side guide.

The actuators 324 can be powered by pneumatics, hydraulics, screw mechanisms, cables, linkages, gear sets and other power-generating arrangements known to those of ordinary skill in the art. In this example, each actuator 324 includes a pneumatic cylinder 332 having a rod 334 extendible therefrom for laterally moving the side guide 316 and the cradle rail 314 to the watercraft-receiving position shown (from the watercraft-received position shown in FIGS. 4 and 5). The cylinder 332 includes two ends—a first end 336 and an opposite second end 338. The second end 338 of the cylinder has an aperture that receives the rod 334. The rod 334 also includes two ends—a first end 340 and an opposite second end 342. The second end 342 of the rod is retractable into the cylinder 332, and the first end 340 of the rod is connected to the extension plate member 324. While the example of FIG. 3 illustrates a side guide 316 and a cradle rail 314 moved by an independent actuator component, those skilled in the art will appreciate that the side guide and cradle rail could alternatively be moved using the same power source as the hoisting components of the lift system 300 (e.g., the reel shown in FIG. 1).

FIG. 4 illustrates a front view of a present watercraft lift system 400 in a lowered, watercraft-received position. As described in association with FIG. 2 (above), confines of the lift system 400 can be defined by four corner pilings or posts 406 and a lower frame assembly 410 interconnecting the piling or posts 406. The confines can include a width W and a length L. Disposed above the lower frame assembly 410 and within the lift's confines can be a cradle assembly 412. The cradle assembly 412 can include cradle rails 414, 415, on which the hull of a watercraft may rest, and optionally support vertically-extending side guides 416, 417.

At least one cradle rail 414 and/or side guide 416 can laterally move from a watercraft-receiving position (shown in FIGS. 2 and 3) and the watercraft-received position shown. In an example, a distance between the watercraft-receiving position and the watercraft-received position of the cradle rail 414 and/or side guide 416 is at least about 20 inches or at least about 36 inches. In the watercraft-received position, the at least one side guide 416 can assume a position that is adjacent to a side of the received watercraft and spaced about 120 inches or less, about 112 inches or less, or about 108 inches or less, for example, from the other side guide 417. The cradle rail 414 can similarly assume a narrower position, such as a position that is about 24 inches or less, about 20 inches or less, or about 16 inches or less, for example, from a center of a watercraft's hoisted position. The lateral retraction of the cradle rail 414 and/or side guide 416 allows the lift system 400 to align and center a received watercraft onto cradle rails and secure a position of the watercraft to prevent any material degree of crosswise, lateral swing due to wind or waves, for example.

In some examples, the at least one cradle rail 414 and/or side guide 416 move laterally from the watercraft-receiving position to the watercraft-received position before the watercraft is lifted vertically. This can be advantageous when currents within the water, waves, wakes and the like can cause the watercraft to be moved laterally in the horizontal plane before being hoisted. In other examples, the at least one cradle rail 414 and/or side guide 416 move laterally from the watercraft-receiving position to the watercraft-received position while the watercraft is lifted vertically at least partially out of the water.

FIG. 5 illustrates a fragmented front view of one side of the watercraft lift system shown in FIG. 4. One of ordinary skill in the art will appreciate that similar or duplicate features shown and described in this drawing can be incorporated on the other side of the lift system such that both cradle rails 514, 515 and/or both side guides 516, 517 can laterally move from a watercraft-receiving position (shown in FIGS. 2 and 3) to the watercraft-received position shown.

As shown in FIG. 5, a cradle assembly 512 can include one or more actuators 524 connected to one or more extension plate members 526 to move a cradle rail 514 and a side guide 516 between the watercraft-receiving position (shown in FIGS. 2 and 3) and the watercraft-received position shown. In this example, the cradle assembly 512 includes a first actuator and extension plate member combination 528 at the front of the lift system 500 and a second actuator and extension plate member combination 530 at the back of the lift system 500. Front and back end portions of the cradle rail 514 and the side guide 516 can be connected to the extension plate members 526 so that movement of the plate members by the actuators 524 causes corresponding movement of the side guide and the cradle rail.

In this example, each actuator 524 includes a pneumatic cylinder 532 having a rod 534 retractable therein for laterally moving the cradle rail 514 and the side guide 516 from the watercraft-receiving position (shown in FIGS. 2 and 3) to the watercraft-received position shown. The cylinder 532 includes two ends—a first end 536 and an opposite second end 538. The second end 538 of the cylinder has an aperture that receives the rod 534. The rod 534 also includes two ends—a first end 540 and an opposite second end 542. The second end 542 of the rod is retractable into the cylinder 532, and the first end 540 of the rod is connected to the extension plate member 524.

Figure 6:
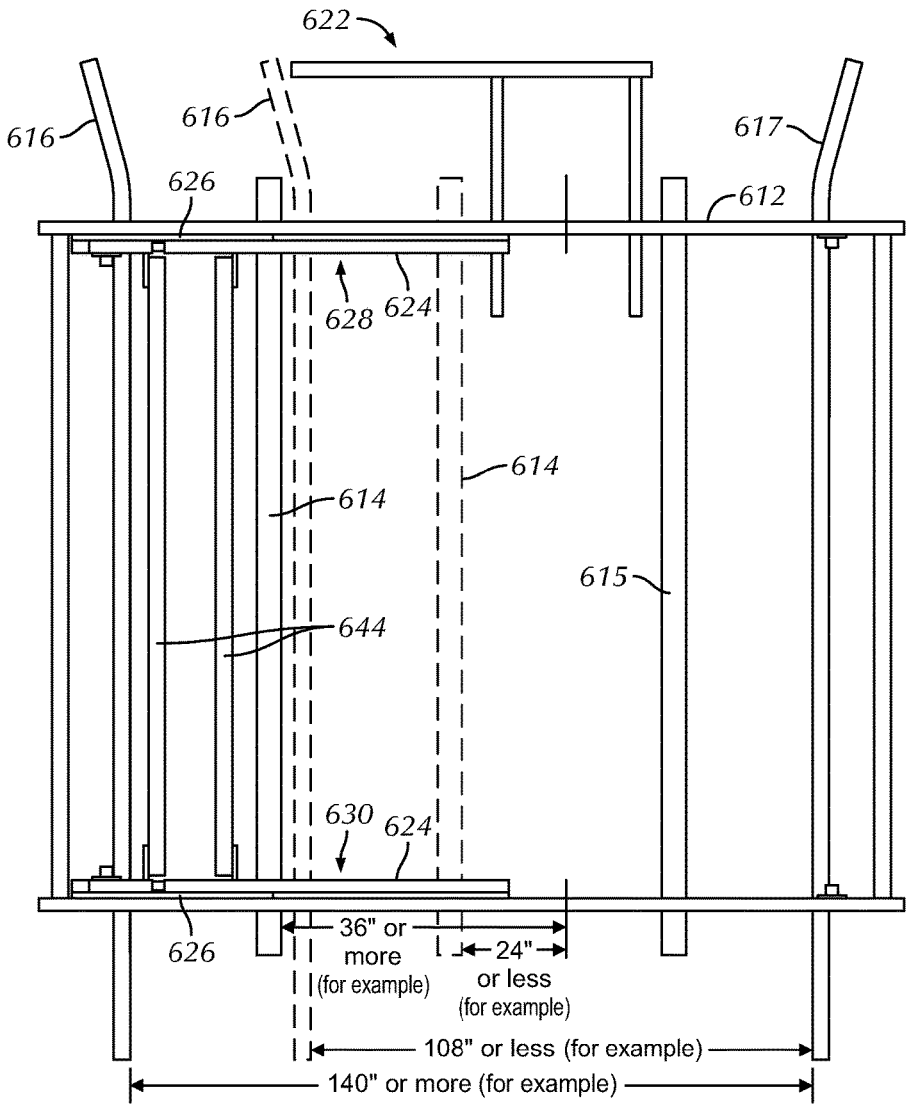
FIG. 6 illustrates an elevated view of portions of a present watercraft lift system, as constructed in accordance with at least one embodiment, including a side guide and a cradle rail movable between a watercraft-receiving position (solid lines) and a watercraft-received position (phantom lines).

FIG. 6 illustrates an elevated view of a cradle assembly 612 and side guides 616, 617 of a present watercraft lift system. The cradle assembly 612 can include cradle rails 614, 615 on which a hull of a watercraft may rest. The side guides 616, 617 can be supported by the cradle assembly 612 and extend vertically therefrom.

At least one cradle rail 614 and/or side guide 616 can laterally move between a watercraft-receiving position (shown by solid lines) and a watercraft-received position (shown in by phantom lines). In the watercraft-receiving position, the at least one side guide 616 can assume a position that is about 140 inches or more, for example, from the other side guide 617. The at least one cradle rail 614 can similarly assume a wider position that is about 36 inches or more, for example, from a center of a watercraft's hoisted position. This positioning of the side guide 616 and/or cradle rail 614 allow the present lift system to provide a watercraft-receiving entrance 622 that is 20-36 inches, for example, wider than convention lift systems, thereby allowing for easier watercraft piloting into and out of the lift. In the watercraft-received position, the at least one side guide 616 can assume a position that is adjacent to a side of the received watercraft and spaced about 120 inches or less, 112 inches or less, or about 108 inches or less, for example, from the other side guide 617. The cradle rail 614 can similarly assume a narrower position, such as a position that is about 24 inches or less, about 20 inches or less, or about 16 inches or less, for example, from a center of a watercraft's hoisted position. This positioning of the side guide 616 and/or cradle rail 614 allows the lift system to align and center a received watercraft onto the cradle assembly 612 and secure a position of the watercraft to prevent any material degree of crosswise, lateral swing due to wind or waves, for example.

The cradle assembly 612 can include one or more actuators 624 connected to one or more extension plate members 626 to move the cradle rail 614 and the side guide 616 between the watercraft-receiving and watercraft-received positions. In this example, the cradle assembly 612 includes a first actuator and extension plate member combination 628 at the front of the lift system 600 and a second actuator and extension plate member combination 630 at the back of the lift system 600. The first and second combinations 628, 630 can be connected by one or more longitudinal support members 642 to guide movement of the cradle rail 614 and the side guide 616 without binding. Front and back end portions of the cradle rail 614 and the side guide 616 can be connected to the extension plate members 626 so that movement of the plate members by the actuators 624 causes corresponding movement of the cradle rail and the side guide.

Figure 7:
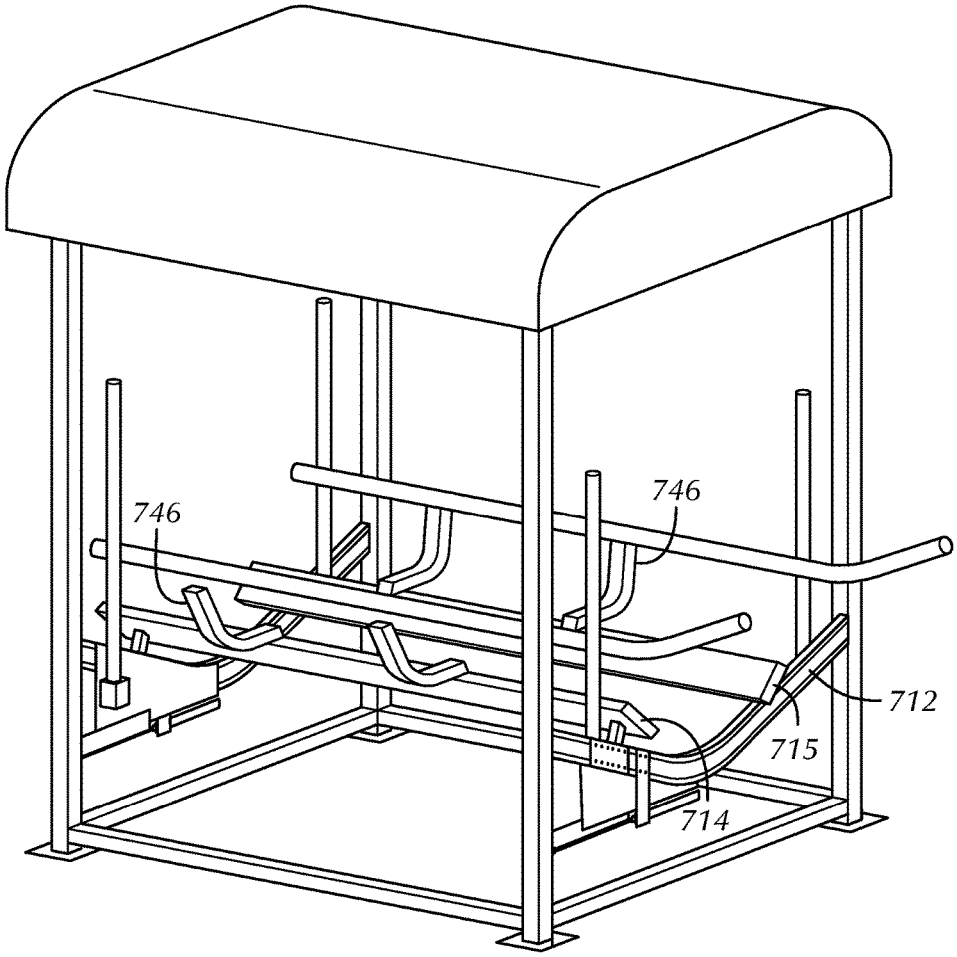
FIG. 7 illustrates a perspective view of a present watercraft lift system, as constructed in accordance with at least one embodiment, including optional cradle rail extensions.

FIG. 7 illustrates a perspective view of a present watercraft lift system 700 including optional cradle rail extensions 746. The cradle rail extensions 746 can be connected to cradle rails 714, 715 of the lift system's cradle assembly 712 to allow lateral movement of at least one of the cradle rails to contact a received watercraft and move it to a center position for hoisting, even when the cradle assembly 712 is in a fully lowered position under water.

Figure 8:
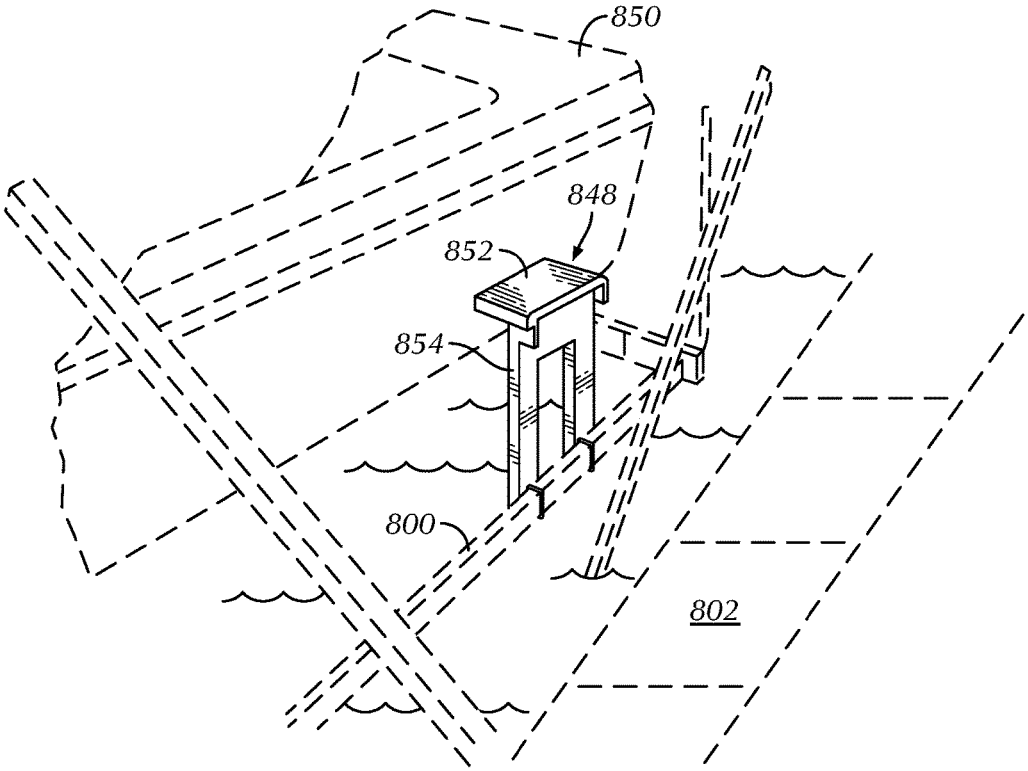
FIG. 8 illustrates a perspective view of an optional step assembly, as constructed in accordance with at least one embodiment, for attachment to a frame assembly of the present watercraft lift system.

FIG. 8 illustrates a perspective view of a present watercraft lift system 800 including an optional step assembly 848. Often, the frame structure of a watercraft lift system is located adjacent to a dock 802, allowing users an access point to a raised or hoisted watercraft 850. Due to differences in the designs of watercraft lift systems and environmental conditions, a user can be required to step across a large gap between the dock 802 and the watercraft 850. This makes entry into and exit out of a raised watercraft difficult for some users.

The step assembly 848 can make entry into and exit out of a raised watercraft 850 easier and more accommodating. The step assembly 848 can include a platform 852 affixed to a vertical member 854 removably connected to a horizontal component of the lift system 800. The platform 852 provides a stepping surface in a gap between the dock 802 and the watercraft 850 located on the lift system 800. In an alternate embodiment, the platform 852 is hinged to a vertical member of the lift system 800 and movable between a raised position and a lowered position. In the raised position, the platform 852 is orientated coplanar with the vertical member to allow for the watercraft 850 to entry the lift system 800 without the risk of striking the platform. In the lowered position, the platform 852 is orientated perpendicular to the vertical member and acts as a step to aid in the entry and exit from a watercraft 850 retained within the lift.

Figure 9:
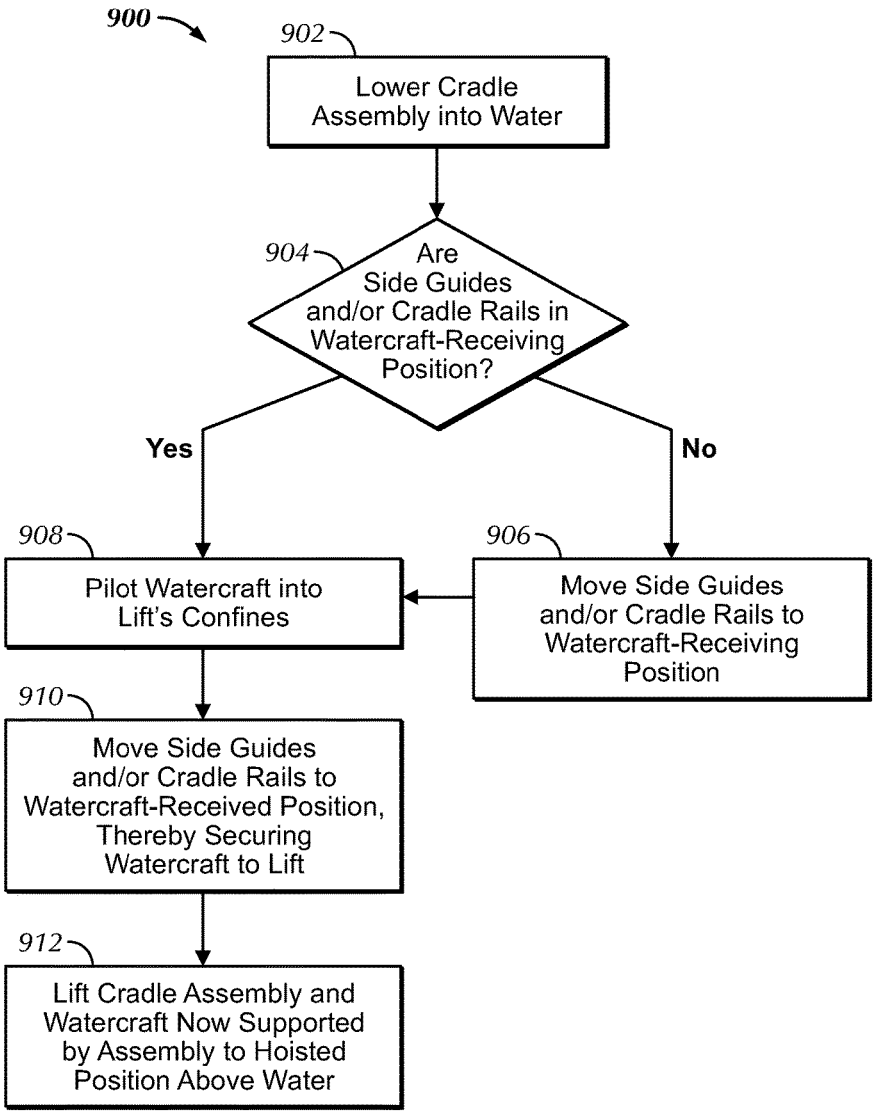
FIG. 9 illustrates a method of piloting a watercraft into a present watercraft lift system, at constructed in accordance with at least one embodiment.

FIG. 9 illustrates a method 900 of piloting a watercraft into a present watercraft lift system.

At 902, a cradle assembly including cradle rails, on which a hull of the watercraft may rest, and optionally supporting vertically-extending side guides is lowered into water. The cradle assembly can be attached by pulleys to at least one cable, which can be connected to a reel that is manually or electrically powered. The reel acts like a winch to extend or retract the cable. As the reel is unwound and the cable extends, the cradle assembly can be lowered into the water.

At 904, a determination of whether the side guides and/or the cradle rails are in a watercraft-receiving position is made. In the watercraft-receiving position, at least one side guide can assume a position that is adjacent to the width confines on one side of the lift system and about 140 inches or more, for example, from the other side guide. At least one cradle rail can similarly assume a wider position that is about 36 inches or more, for example, from a center of a watercraft's hoisted position. This positioning of the side guides and cradle rails allows the lift system to provide a watercraft-receiving entrance that is 20-36 inches, for example, wider than convention lift systems, thereby allowing for easier watercraft piloting into in the lift.

The determination can be made based on a visual inspection of the side guides or cradle rails (e.g., via cradle rail extensions), or can be made by a controller and displayed on a mobile device or on a watercraft display. The controller can communicate with a sensor positioned on the lift system to make the determination. The display can show the relative position of each set of side guides and cradle rails. Alternatively, a power source in communication with the cradle assembly can be programmed to automatically move at least one side guide and/or cradle rail to the watercraft-receiving position when the cradle assembly is moved to a lowered position.

If it is determined that the side guides and/or the cradle rails are not in the watercraft-receiving position then, at 906, the side guides and/or the cradle rails are moved to such position. In an example, the cradle assembly can include one or more actuators connected to one or more extension plate members or cables to move a side guide and a cradle rail from a closed, watercraft-received position to the open, watercraft-receiving position.

If it is determined that the side guides and/or the cradle rails are in the watercraft-receiving position then, at 908, a user pilots the watercraft into the lift system. A front or leading portion of each side guide or cradle rail can be formed to angle outward, creating a funnel shape into which the front of the watercraft can be directed. This funnel shape can accommodate additional misalignment of the watercraft as it is piloted into the lift system.

At 910, after the watercraft enters the lift system, at least one side guide and/or cradle rail can automatically move laterally toward the side(s) of the watercraft to a watercraft-received position. In the watercraft-received position, the at least one side guide can assume a position that is adjacent to a side of the received watercraft and spaced about 120 inches or less, about 112 inches or less, or about 108 inches or less, for example, from the other side guide. The at least one cradle rail can similarly assume a narrower position, such as a position that is about 24 inches or less, about 20 inches or less, or about 16 inches or less, for example, from a center of a watercraft's hoisted position. This positioning of the side guide and/or cradle rail allows the lift system to align and center the received watercraft onto cradle rails and secure a position of the watercraft to prevent any material degree of crosswise, lateral swing due to wind or waves, for example.

The trigger causing the at least one side guide and/or cradle rail to laterally retract can be senor- or linkage-based. For example, when a sensor (e.g., FIG. 2 at 260) detects that the watercraft is a certain amount into the lift system's confines (e.g., 80% in), the actuator connected to the side guide and/or cradle rail can be powered. As another example, the lift system may include a cantilevered design that causes inward movement of the side guide and/or cradle rail when then watercraft triggers a linkage as it enters the lift.

In some examples, movement of the side guides or cradle rails can be confined to limits monitored by an optical sensor (e.g., FIG. 2 at 260) or preset mechanical stop (e.g., FIG. 2 at 262) integrated into the lift system. The limits can be based, at least in part, on the width dimensions of the watercraft intended to be used with the lift system.

Once the watercraft is cradled and secured, it can be lifted vertically out of the water, at 912. The user can activate the reel to rewind the cable, thereby lifting the cradle assembly and the watercraft now supported by the assembly. The cable can be rewound until the watercraft is completely or substantially lifted out of the water. In some examples, the at least one side guide and/or cradle rail move laterally from the watercraft-receiving position to the watercraft-received position before the watercraft is lifted vertically. In other examples, the at least one side guide and/or cradle rail move laterally from the watercraft-receiving position to the watercraft-received position at the same time the watercraft is lifted vertically out of the water. A switch can be integrated into the watercraft lift system, allowing a user to choose whether lateral and vertical movements occur simultaneously or consecutively.

Closing Notes:

For at least the past half-century, watercraft lift systems have been designed substantially the same—they solely move up and down. The present watercraft lift system and related method enhance conventional lift systems by adding the concept of lateral motion of at least one cradle rail and/or side guide. The movable cradle rail(s) and/or side guide(s), when in a watercraft-receiving position, provides significant advantages in guiding a watercraft smoothly into its mooring position without damage via a wider entrance than conventional lift systems. The movable cradle rail(s) and/or side guide(s), when in a watercraft-received position, also provides significant advantages by laterally aligning, centering and securing a position of the received watercraft within the lift system. Problems of watercraft misalignment relative to a lift's entrance or cradle rails, which can be caused by heavy winds or waves or the difficulty of precisely steering watercraft, can be alleviated by the present subject matter.

It is believed that the present watercraft lift system and related method will take the place of conventional lift systems and methods, since they allow for easier and safer watercraft mooring. This easier and safer mooring can reduce or eliminate damage to watercraft and lift systems.

The above Detailed Description includes references to the accompanying drawings, which form a part of the Detailed Description. The Detailed Description should be read with reference to the drawings. The drawings show, by way of illustration, specific embodiments in which the present system and method can be practiced. These embodiments are also referred to herein as "examples."

The above Detailed Description is intended to be illustrative and not restrictive. For example, the above-described examples (or one or more features or components thereof) can be used in combination with each other. Other embodiments can be used, such as by one of ordinary skill in the art upon reviewing the above Detailed Description. Also, various features or components have been or can be grouped together to streamline the disclosure. This should not be interpreted as intending that an unclaimed disclosed feature is essential to any claim. Rather, inventive subject matter can lie in less than all features of a disclosed embodiment. Thus, the following claim examples are hereby incorporated into the Detailed Description, with each example standing on its own as a separate embodiment:

In Example 1, a watercraft lift system can comprise a cradle assembly including substantially parallel first and second cradle rails, and at least one side guide connected to the cradle assembly. One or both of the first cradle rail or the at least one side guide can be configured to be movable in a lateral direction, which is generally parallel to a surface of water, between a watercraft-receiving position and a watercraft-received position.

In Example 2, the watercraft lift system of Example 1 can optionally be configured such that movement of one or both of the first cradle rail or the at least one side guide in the lateral direction, from the watercraft-receiving position to the watercraft-received position, occurs automatically upon positioning of a watercraft above the cradle assembly.

In Example 3, the watercraft lift system of Example 2 can optionally further comprise a sensor positioned or configured to sense the position of the watercraft relative to the cradle assembly.

In Example 4, the watercraft lift system of any one or any combination of Examples 1-3 can optionally be configured such that movement of one or both of the first cradle rail or the at least one side guide in the lateral direction is limited by a mechanical stop or a sensor measurement.

In Example 5, the watercraft lift system of any one or any combination of Examples 1-4 can optionally be configured such that the at least one side guide is padded along its inward-facing surface.

In Example 6, the watercraft lift system of any one or any combination of Examples 1-5 can optionally be configured such that a front-end portion of the at least one side guide is angled outward.

In Example 7, the watercraft lift system of any one or any combination of Examples 1-6 can optionally be configured such that the at least one side guide includes first and second side guides.

In Example 8, the watercraft lift system of Example 7 can optionally be configured such that, when in the watercraft-receiving position, the first side guide is spaced at least about 140 inches away from the second side guide.

In Example 9, the watercraft lift system of any one of Examples 7 or 8 can optionally be configured such that, when in the watercraft-received position, the first side guide is spaced about 120 inches or less away from the second side guide.

In Example 10, the watercraft lift system of any one or any combination of Examples 1-9 can optionally be configured such that a distance between the watercraft-receiving position and the watercraft-received position of the first cradle rail or the at least one side guide is at least about 20 inches.

In Example 11, the watercraft lift system of any one or any combination of Examples 1-10 can optionally be configured such that, when in the watercraft-receiving position, the first cradle rail is spaced at least about 72 inches away from the second cradle rail.

In Example 12, the watercraft lift system of Example 11 can optionally be configured such that, when in the watercraft-received position, the first cradle rail is about 48 inches or less away from the second cradle rail.

In Example 13, the watercraft lift system of any one or any combination of Examples 1-12 can optionally further comprise an actuator to laterally move one or both of the first cradle rail or the at least one side guide between the watercraft-receiving position and the watercraft-received position.

In Example 14, the watercraft lift system of Example 13 can optionally be configured such that the actuator is operably connected to the first cradle rail or the at least one side guide via one or more cables or extension plate members.

In Example 15, the watercraft lift system of any one of Examples 13 or 14 can optionally be configured such that the actuator further moves the cradle assembly vertically from a lowered position, submersible in the water, to an elevated position, above the water.

In Example 16, the watercraft lift system of any one or any combination of Examples 1-15 can optionally further comprise a cradle rail extension connected to each of the first and second cradle rails.

In Example 17, a method of piloting a watercraft into a watercraft lift system can comprise lowering a cradle assembly, including first and second cradle rails and optionally supporting first and second vertically-extending side guides, into water; ensuring the first cradle rail and/or the first side guide is in a watercraft-receiving position and if not, laterally moving the first cradle rail and/or the first side guide until such positioning is achieved; piloting the watercraft into the watercraft lift system, including positioning the watercraft over the cradle assembly; and laterally moving the first cradle assembly and/or the first side guide toward a side of the watercraft to a watercraft-received position.

In Example 18, the method of Example 17 can optionally be configured such that ensuring the first cradle rail and/or the first side guide is in the watercraft-receiving position includes displaying a signal generated by a sensor positioned on the watercraft lift system.

In Example 19, the method of any one of Examples 17 or 18 can optionally be configured such that laterally moving the first cradle rail and/or the first side guide toward the side of the watercraft includes securing a lateral position of the watercraft relative to the watercraft lift system.

In Example 20, the method of any one or any combination of Examples 17-19 can optionally be configured such that laterally moving the first cradle rail and/or the first side guide until it is in the watercraft-received position includes automatically moving the first cradle rail and/or the first side guide at least about 20 inches laterally.

In Example 21, the method of any one of Examples 17-20 can optionally further comprise lifting the watercraft vertically out of the water.

In Example 22, the method of Example 21 can optionally be configured such that laterally moving the first cradle rail and/or the first side guide toward the side of the watercraft and lifting the watercraft vertically out of the water occur simultaneously.

In Example 23, the system or method of any one or any combination of Examples 1-22 can optionally be configured such that all components or options recited are available to use or select from.

Certain terms are used throughout this patent document to refer to features or components. As one skilled in the art will appreciate, different people may refer to the same feature or component by different names. This patent document does not intend to distinguish between components or features that differ in name but not in function.

For the following defined terms, certain definitions shall be applied unless a different definition is given elsewhere in this patent document. The terms "a," "an," and "the" are used to include one or more than one, independent of any other instances or usages of "at least one" or "one or more." The term "or" is used to refer to a nonexclusive or, such that "A or B" includes "A but not B," "B but not A," and "A and B." When an element is referred to as being "coupled" or "connected" to another element, it can be directly coupled or connected to the other element or an intervening element may be present. In contrast, when an element is referred as being "directly coupled" or "directly connected" to another element, there are no intervening elements present. All numeric values are assumed to be modified by the term "about," whether or not explicitly indicated. The term "about" refers to a range of numbers that one of skill in the art considers equivalent to the recited value (e.g., having the same function or result). In many instances, the term "about" can include numbers that are rounded to the nearest significant figure. The recitation of numerical ranges by endpoints includes all numbers and sub-ranges within and bounding that range (e.g., 1 to 4 includes 1, 1.5, 1.75, 2, 2.3, 2.6, 2.9, etc. and 1 to 1.5, 1 to 2, 1 to 3, 2 to 3.5, 2 to 4, 3 to 4, etc.).

The scope of the present system and method should be determined with reference to the appended claims, along with the full scope of equivalents to which such claims are entitled. In the appended claims, the terms "including" and "in which" are used as the plain-English equivalents of the respective terms "comprising" and "wherein." Also, in the following claims, the terms "including" and "comprising" are open-ended; that is, a device or method that includes features or components in addition to those listed after such a term in a claim are still deemed to fall within the scope of that claim. Moreover, in the following claims, the terms "first," "second" and "third," etc. are used merely as labels, and are not intended to impose numerical requirements on their objects.

The Abstract is provided to allow the reader to quickly ascertain the nature of the technical disclosure. It is submitted with the understanding that it will not be used to interpret or limit the scope or meaning of the claims.

What is claimed is:

1. A watercraft lift system for placement in a body of water, comprising:

a cradle assembly including longitudinally-extending first and second cradle rails, the cradle rails oriented substantially parallel to one another; and at least one side guide longitudinally-extending in a direction substantially parallel to the first and second cradle rails and connected to the cradle assembly such that the first cradle rail and the at least one side guide move together, wherein both the first cradle rail and the at least one side guide are movable in a lateral direction, which is generally parallel to a surface of the body of water and generally perpendicular to the direction of their longitudinal extensions, between a watercraft-receiving position and a watercraft-received position when a watercraft is positioned within the watercraft lift system's confines.

2. The watercraft lift system of claim 1, wherein movement of both of the first cradle rail and the at least one side guide in the lateral direction, from the watercraft-receiving position to the watercraft-received position, occurs automatically upon positioning of a watercraft above the cradle assembly.

3. The watercraft lift system of claim 2, further comprising a sensor positioned or configured to sense the position of the watercraft relative to the cradle assembly.

4. The watercraft lift system of claim 1, wherein movement of both of the first cradle rail and the at least one side guide in the lateral direction is limited by a mechanical stop or a sensor measurement.

5. The watercraft lift system of claim 1, wherein the at least one side guide is padded along its inward-facing surface.

6. The watercraft lift system of claim 1, wherein a front-end portion of the at least one side guide is angled outward.

7. The watercraft lift system of claim 1, wherein the at least one side guide includes first and second side guides.

8. The watercraft lift system of claim 7, wherein, when in the watercraft-receiving position, the first side guide is spaced at least about 140 inches away from the second side guide.

9. The watercraft lift system of claim 8, wherein, when in the watercraft-received position, the first side guide is spaced about 120 inches or less away from the second side guide.

10. The watercraft lift system of claim 1, wherein a distance between the watercraft-receiving position and the watercraft-received position of the first cradle rail or the at least one side guide is at least about 20 inches.

11. The watercraft lift system of claim 1, wherein, when in the watercraft-receiving position, the first cradle rail is spaced at least about 72 inches away from the second cradle rail.

12. The watercraft lift system of claim 11, wherein, when in the watercraft-received position, the first cradle rail is about 48 inches or less away from the second cradle rail.

13. The watercraft lift system of claim 1, further comprising one or more actuators, wherein the one or more actuators are configured to laterally move both the first cradle rail and the at least one side guide between the watercraft-receiving position and the watercraft-received position.

14. The watercraft lift system of claim 13, wherein the one or more actuators are operably connected to the first cradle rail and the least one side guide via one or more cables or extension plate members.

15. The watercraft lift system of claim 13, wherein the one or more actuators further move the cradle assembly vertically between a lowered position, submersible in the water, and an elevated position, above the water.

16. The watercraft lift system of claim 1, further comprising a cradle rail extension connected to each of the first and second cradle rails.

17. A method of piloting a watercraft into a watercraft lift system, comprising:

lowering a cradle assembly, including longitudinally-extending first and second cradle rails oriented substantially parallel to one another, on which a hull of the watercraft can rest, and supporting first and second side guides longitudinally-extending in a direction substantially parallel to the first and second cradle rails, into water;

ensuring the first cradle rail and the first side guide is in a watercraft-receiving position;

if the first cradle rail and the first side guide are not in the watercraft-receiving position, laterally moving the first cradle rail and the first side guide until they are in the watercraft-receiving position;

piloting the watercraft into the watercraft lift system's confines, including positioning the watercraft over the cradle assembly; and with the watercraft positioned within the watercraft lift system's confines, laterally moving the first cradle rail and the first side guide toward a side of the watercraft to a watercraft-received position, said lateral movement generally perpendicular to the longitudinal extensions of the first cradle rail and the first side guide.

18. The method of claim 17, wherein ensuring the first cradle rail and the first side guide are in the watercraft-receiving position includes displaying a signal generated by a sensor positioned on the watercraft lift system.

19. The method of claim 17, wherein laterally moving the first cradle rail and the first side guide toward the side of the watercraft includes securing a lateral position of the watercraft relative to the watercraft lift system.

20. The method of claim 17, wherein laterally moving the first cradle rail and the first side guide until they are in the watercraft-received position includes automatically moving the first cradle rail and the first side guide at least about 20 inches laterally.

21. The method of claim 17, further comprising lifting the watercraft vertically out of the water.

22. The method of claim 21, wherein laterally moving the first cradle rail and the first side guide toward the side of the watercraft and lifting the watercraft vertically out of the water occur simultaneously.

* * * * *